US009279261B2

(12) United States Patent
Schneider et al.

(10) Patent No.: US 9,279,261 B2
(45) Date of Patent: Mar. 8, 2016

(54) METHOD FOR MANUFACTURING A FORMWORK ELEMENT

(71) Applicant: Peri GmbH, Weissenhorn (DE)

(72) Inventors: Werner Schneider, Erbach-Bach (DE); Andreas Meyer, Kempten (DE)

(73) Assignee: Peri GmbH, Weiβenhorn (DE)

( * ) Notice: Subject to any disclaimer, the term of this patent is extended or adjusted under 35 U.S.C. 154(b) by 3 days.

(21) Appl. No.: 14/446,376

(22) Filed: Jul. 30, 2014

(65) Prior Publication Data

US 2014/0331499 A1 Nov. 13, 2014

Related U.S. Application Data

(63) Continuation of application No. 13/508,992, filed as application No. PCT/DE2010/050064 on Aug. 30, 2010, now abandoned.

(30) Foreign Application Priority Data

Nov. 13, 2009 (DE) ..... 10 2009 046 689

(51) Int. Cl.

| | |
|---|---|
| ***E04G 17/04*** | (2006.01) |
| ***E04G 9/06*** | (2006.01) |
| ***E04G 17/00*** | (2006.01) |

(52) U.S. Cl.

CPC *E04G 17/04* (2013.01); *E04G 9/06* (2013.01); *E04G 17/001* (2013.01); *Y10T 29/49627* (2015.01)

(58) Field of Classification Search

CPC ..... E04B 2/48; E04B 2/50; E04G 11/087; E04G 17/047; E04G 11/06; E04G 13/00; E04G 9/06; E04G 17/14; E04G 17/045; E04G 17/04; E04G 9/02; E04G 9/08; E04G 15/063; E04G 17/0655; F16B 5/0096; F16B 5/01; B28B 7/0014; B28B 7/0085; B28B 7/0044; B28B 7/02

USPC ..... 264/333; 249/47, 139, 160, 163, 249/168–171, 189, 192–195; 52/421

See application file for complete search history.

(56) References Cited

U.S. PATENT DOCUMENTS

| | | | | |
|---|---|---|---|---|
| 2,164,681 A * | 7/1939 | Fould | ..... | 52/568 |
| 4,768,748 A * | 9/1988 | Leimkuhler et al. | ..... | 249/192 |

(Continued)

FOREIGN PATENT DOCUMENTS

| | | | | |
|---|---|---|---|---|
| AT | 408374 B * | 9/2001 | ..... | F16S 3/02 |
| DE | 19633431 C1 * | 1/1998 | ..... | F16S 1/02 |
| DE | 196 27 121 C2 * | 8/2000 | ..... | F16S 1/00 |

(Continued)

OTHER PUBLICATIONS

Translation of DE 19627121.*

*Primary Examiner* — James Sanders
*Assistant Examiner* — Leith S Shafi
(74) *Attorney, Agent, or Firm* — Paul Vincent

(57) ABSTRACT

A method for manufacturing a formwork element 10 for concrete structures, uses a formwork element having a base body 12 of hollow profile construction with an outer side 14 designed as a form lining. The base body 12 is formed by at least two interlocking sub-segments which are permanently connected to one another at their interlocking edge areas. The sub-segments, such as edge segment and intermediate segment 16, 18, which are advantageously produced through extrusion, are hooked to one another to form an inseparable unit in the connected state.

4 Claims, 5 Drawing Sheets

(56) References Cited

U.S. PATENT DOCUMENTS

| | | | | |
|---|---|---|---|---|
| 6,283,439 | B1 * | 9/2001 | Myers et al. | 249/45 |
| 2005/0061948 | A1 * | 3/2005 | Brennan | 249/167 |
| 2010/0251657 | A1 * | 10/2010 | Richardson et al. | 52/588.1 |
| 2012/0119061 | A1 * | 5/2012 | Au | 249/170 |
| 2012/0223212 | A1 * | 9/2012 | Schneider et al. | 249/187.1 |

FOREIGN PATENT DOCUMENTS

| | | | | |
|---|---|---|---|---|
| DE | 19627121 | C2 * | 8/2000 | F16S 1/00 |
| WO | WO 2009/059410 | A1 * | 5/2009 | E04G 17/00 |

* cited by examiner

METHOD FOR MANUFACTURING A FORMWORK ELEMENT

This application is a continuation of Ser. No. 13/508,992, filed on May 10, 2012 as the national stage of PCT/DE2010/050064, filed on Aug. 30, 2010 and also claims Paris Convention priority from DE 10 2009 046 689.4, filed on Nov. 13, 2009, the entire disclosures of which are hereby incorporated by reference.

BACKGROUND OF THE INVENTION

The present invention concerns a method for manufacturing a formwork element for concrete structures, comprising a base body of hollow profile construction, the outer side of which is designed as a form lining.

Formwork elements that are ready for use have a base body, on which, in general, further extension elements, such as e.g. sealing elements, are arranged, and are used for formwork into which fresh concrete is introduced for producing concrete components, such as e.g. walls, ceilings and the like. For this work, the formwork elements must be available in different widths, for which reason the overall production costs are high.

It is the underlying purpose of the invention to further develop a formwork element of the above-mentioned type in such a way that it can be produced in an inexpensive fashion.

SUMMARY OF THE INVENTION

This object is achieved in accordance with the invention with a method for manufacturing a formwork element, the formwork element having a base body of hollow profile construction having an outer side constituting a form lining, wherein the base body has at least two interlocking sub-segments which are permanently connected to each other at mutually interlocking edge areas by means of a hooked connection formed proximate inner and outer sides of the sub-segments, thereby constituting an inseparable unit. The hooked connection extends through a large fraction of the entire length of the base body or through a large fraction of an entire length of the inner and outer sides of the base body. The hooked connection has a locking groove disposed on one sub-segment proximate the inner side of the base body, the locking groove capturing an inner wall section of the other sub-segment, wherein the locking groove is partially covered by an inner wall leg of the sub-segment having the locking groove. The inner wall leg protrudes parallel to the inner side of the base body 12 and the locking groove has a groove bottom, one end of which is disposed on a side wall of the sub-segment, and a groove flank angled toward the inner side of the base body. The profiled inner wall section of the other sub-section has an offset edge area which engages below the inner wall leg as well as an integral profiled strip which protrudes into and at a side of the locking groove towards the groove bottom and which seats over a large area on the groove flank in a locked position of the inner wall section. The hooked connection also comprises a snap-on hook proximate the outer side of the base body and disposed on one sub-segment to snap into locked engagement with a locking element disposed on the other sub-segment. The inventive method for manufacturing this formwork element comprises the steps of:

introducing the sub-segment having the offset edge area into the locking groove of the other sub-segment until the offset edge area is guided beneath the inner wall leg of the other sub-segment and subsequent thereto;

generating the hooked connection by pivoting one sub-segment relative to the other sub-segment under forced guidance of the offset edge area of the inner wall section and in a hinge-like manner in the locking groove until the snap-on hook snaps into locked engagement with the locking element, thereby bringing the offset edge area of the inner wall section of the one sub-segment into a locked position in which the profiled strip of the one sub-segment seats on the groove flank of the locking groove of the other sub-segment.

In accordance with the invention, the base body of the formwork element is formed from at least two interlocking sub-segments, which are permanently connected to each other at their interlocking edge areas following assembly of the sub-segments.

The advantage associated with the invention substantially consists in that a plurality of formwork elements of different widths can be produced with only a few standardized sub-segments in a simple and inexpensive fashion. When the connection between the individual sub-segments is correspondingly designed, e.g. by means of rivets, the hollow profile construction of the base body provides a robust formwork element structure that, in particular, can also largely absorb high transverse forces without deformation.

The base body of the formwork element is preferably produced from extruded light metal, which permits inexpensive production of even complicated hollow profile shapes in only one method step. The reduced width of the sub-segments compared to the overall width of the formwork element or the base body thereby permits production on extrusion devices, a large number of which are available on the market, such that expensive special extrusion devices are no longer needed for production. Due to the mono-material light metal construction of the base body, the latter can moreover be easily recycled into the materials cycle, which takes account of, in particular, environmental and economic aspects.

In accordance with the invention, the sub-segments are hooked to one another. This not only ensures simple and fast assembly of the formwork element but also a high degree of operational safety during the entire service life of the formwork element.

The sub-segments may be designed as edge segments and/or intermediate segments. For this reason, the base body of the formwork element may only have two sub-segments, each formed as an edge segment, or at least one additional intermediate segment that is disposed between the edge segments. The edge segments only have an edge area that can be permanently connected or hooked to another sub-segment, i.e. another edge segment or intermediate segment to form a formwork element (base body).

The edge segments have, in particular, locking struts and/or semicircular anchor holes in their outer edge areas for detachably connecting the formwork element to another formwork element.

In order to provide a maximum spectrum of use of the formwork element, the edge segments and/or intermediate segments may have, in particular, different widths. For this reason, formwork elements with finely graduated width dimensions can be provided at little cost, wherein the formwork elements may be formed either from a small or a larger number of sub-segments in dependence on the widths of the edge segments and intermediate segments that are available.

In accordance with the invention, the hooked connection comprises hook elements formed on the sub-segments. This reduces the overall production costs of the sub-segment and simplifies assembly of the sub-segments.

The surface quality and the dimensional stability of the concrete element to be produced decisively depend on as small a relative displacement as possible of the sub-segments of the formwork elements or on the degree of deformation of the formwork element under the load of fresh concrete. Even small relative motion of the sub-segments at the form lining abutment region can deteriorate the optical result of the surface structure of the concrete component, requiring expensive subsequent treatment of the concrete component. The hooked connection is therefore advantageously formed on the outer side and on one inner side of the base body. For this reason, the forces exerted by the fresh concrete onto the formwork element can preferably be introduced into those areas of the sub-segments which must, in any event, have a sufficiently large material thickness in view of the load-carrying capacity of the formwork element. On the other hand, the hooked connection can be aligned in a particularly simple fashion for transmission of force components, acting parallel and perpendicularly with respect to the form lining of the formwork element between the sub-segments that are hooked to one another.

The hooked connection thereby advantageously has at least one snap-on hook which is advantageously arranged on one sub-segment in the area of the outer side of the base body and is locked with a locking element arranged on the other sub-segment.

In order to provide maximum stability of the hooked connection with respect to forces that act in an orthogonal direction onto the forming area, the sub-segment comprising the snap-on hook is advantageously supported with its inner and/or outer wall section on a corresponding inner and/or outer wall section of the respective other sub-segment. The snap-on hook is thereby protected in a simple fashion from sliding out of its locked position, at the same time producing a bearing pressure between a retaining surface of the snap-on hook and an engaging-behind surface of the locking element when forces act orthogonally with respect to the form lining. In accordance with a further aspect of the invention, one sub-segment has, in particular, a supporting surface which abuts at least part of a contact surface of the other sub-segment in a form-locking fashion, wherein the contact surface has an undercut behind which the supporting surface engages.

In accordance with the invention, the hooked connection comprises a locking groove, which is arranged on one sub-segment, advantageously in the area of the inner side of the base body and in which an inner wall section of the respective other sub-segment is arranged or fixed.

In order to maximally facilitate assembly of the formwork element, the hooked connection is produced through relative pivoting of the sub-segments to be connected to each other. For this reason, the sub-segments can be utilized as levers for closing the hooked connection, which also permits closing of the hooked connection against pretension of the sub-segments. Since the inventive hooked connection comprises a hook element designed as a locking element and a hook element designed as snap-on hook, the locking element guided in the locking groove is used as a hinge-like guidance of the sub-segments during establishing the hooked connection.

The hooked connection advantageously extends over a major part of the entire length, in particular, over the entire length of the outer and/or inner side of the base body in order to connect the sub-segments with optimum stability.

The hollow profile openings of the formwork element are sealed by means of sealing elements in order to facilitate cleaning in case any soiling such as e.g. fresh concrete, gains access.

In order to provide as flat a form lining as possible, it has moreover turned out to be useful when the sub-segments or the base body of the formwork element are connected, at least at one end face, to a directional profile.

In order to further optimize the surface quality of the concrete components to be produced and minimize the cleaning expense of the formwork element, the outer side of the formwork element or of the sub-segments, which is designed as the form lining, may additionally have a coating which counteracts adhesion of fresh or set concrete. This coating may, in particular, be a plastic coating or a powder coating.

In accordance with the invention, the formwork element has a width of less than 1000 mm, a thickness of 20 to 80 mm and a length of less than 4000 mm, advantageously of less than 3600 mm. In order to render handling particularly simple and safe with respect to weight and outer dimensions of the formwork element, it has turned out to be particularly advantageous in practice when the width of the formwork element does not exceed 600 mm.

The ribs or side walls of the hollow profile (sub-segment) are inclined at an angle of less than 90° between the inner side and the outer side of the formwork element. The absorption of transverse forces can be further improved when the angles are between 30 and 70°. An angle of the ribs or side walls of approximately 45° with respect to the outer side is thereby particularly preferred, since the hollow profile can then be produced at very low cost and the intermediate segments or edge segments of this type can absorb the transverse forces acting on them without being deformed.

Further advantages and advantageous embodiments of the subject matter of the invention can be extracted from the description, the drawing and the claims. The invention is explained in more detail below with respect to embodiments with reference to the drawing.

DESCRIPTION OF THE PREFERRED EMBODIMENT

Figure 1:
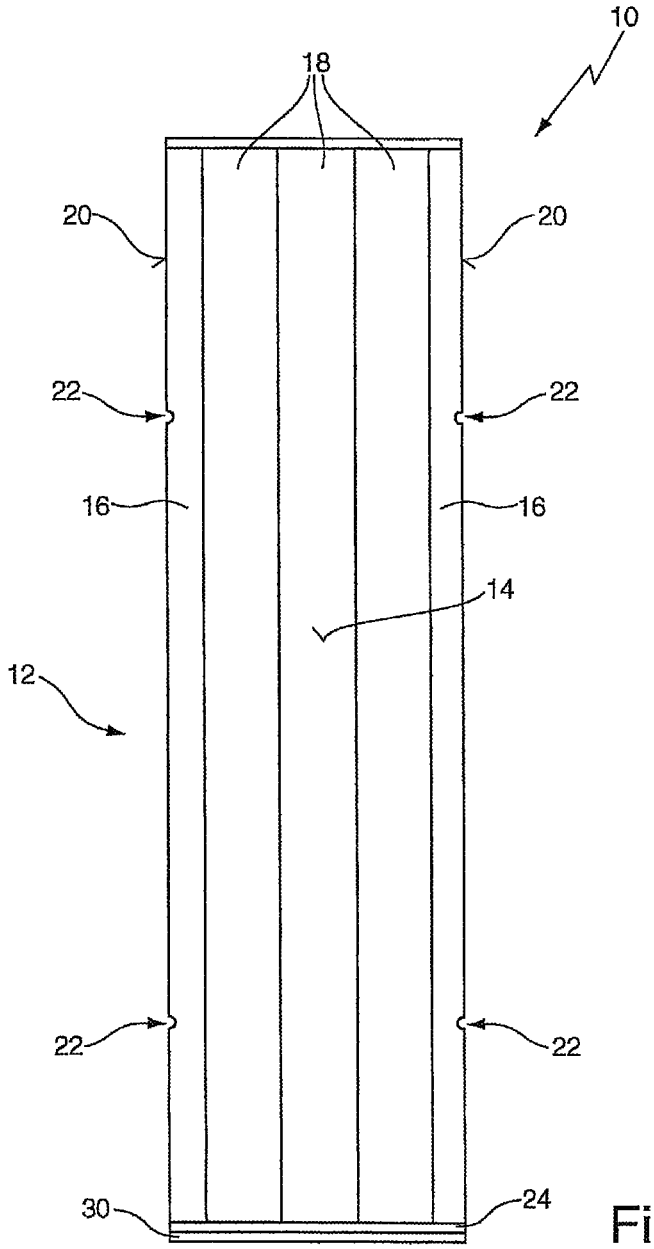
FIG. 1 shows a top view of a formwork element having a total of five sub-segments which are connected to one another via an undetachable hooked connection.

Corresponding components are suitably designated by the same reference numerals in the drawing. The views are highly schematic and not true to scale for a better understanding.

FIG. 1 shows a formwork element 10 for concrete structures having a base body 12 produced from extruded aluminium with a flat outer side 14 that is designed as form lining. The base body 12 of the present formwork element 10 has two edge segments 16 and three intermediate segments 18 arranged between the edge segments 16.

Each formwork element 10 basically terminates at both ends in an edge segment 16, wherein bordering formwork elements 10 can be detachably connected to each other through formwork locks that are not shown in detail in the drawing. Moreover, each edge segment 16 has, at the longitudinal side 20 thereof, two semi-circular anchor holes 22 for yokes that are per se commercially available.

Depending on the embodiment, the formwork element 10 has a width of advantageously up to 1000 mm and a thickness of advantageously 20 to 80 mm. The formwork element 10 may have a length of up to 4000 mm, which is normal in the building industry.

Figure 2:
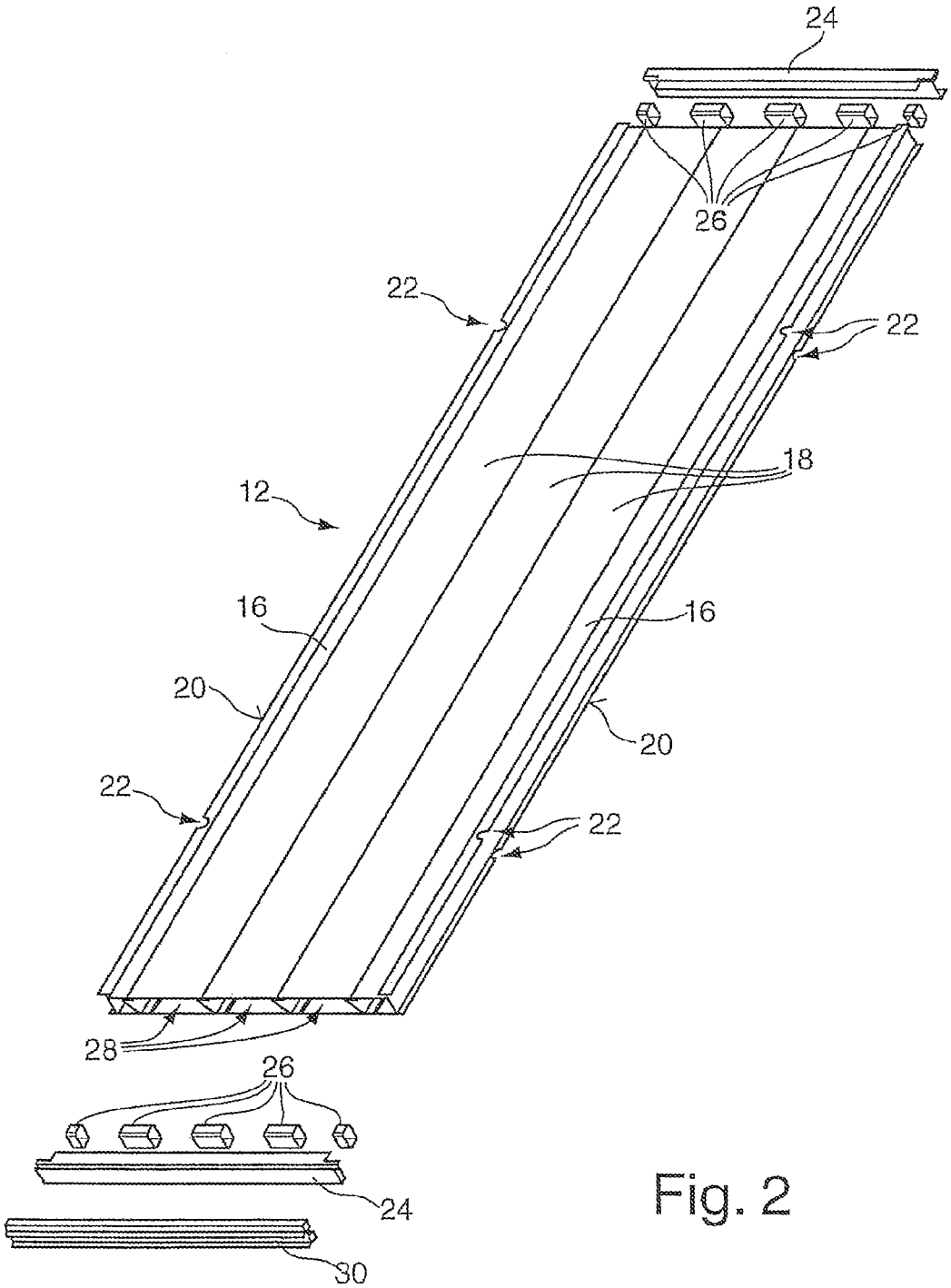
FIG. 2 shows a perspective exploded view of a formwork element in correspondence with FIG. 1.

The edge segments and intermediate segments 16, 18 of the base body 12 are each designed as a hollow profile, which is illustrated in more detail, in particular, in the exploded view of the formwork element 10 of FIG. 2.

The formwork element 10 has profiled blocks 26, which are inserted into front side openings 28 of the edge segments and intermediate segments 16, 18 for reinforcing the base body 12 formed by the edge segments or intermediate segments 16, 18, which are permanently connected to one another, i.e. can be separated again only by mechanical power, and for mounting support rails 24 at the front side.

Each support rail 24 is thereby riveted to the profiled blocks 26 and the edge segments or intermediate segments 16, 18 in a fashion not shown in more detail to additionally ensure precise alignment of the edge segments and intermediate segments with respect to one another. An elastic sealing element 30 is moreover disposed on the support rail 24 arranged at the bottom in the figure to facilitate stripping of the formwork element 10.

Figure 3:
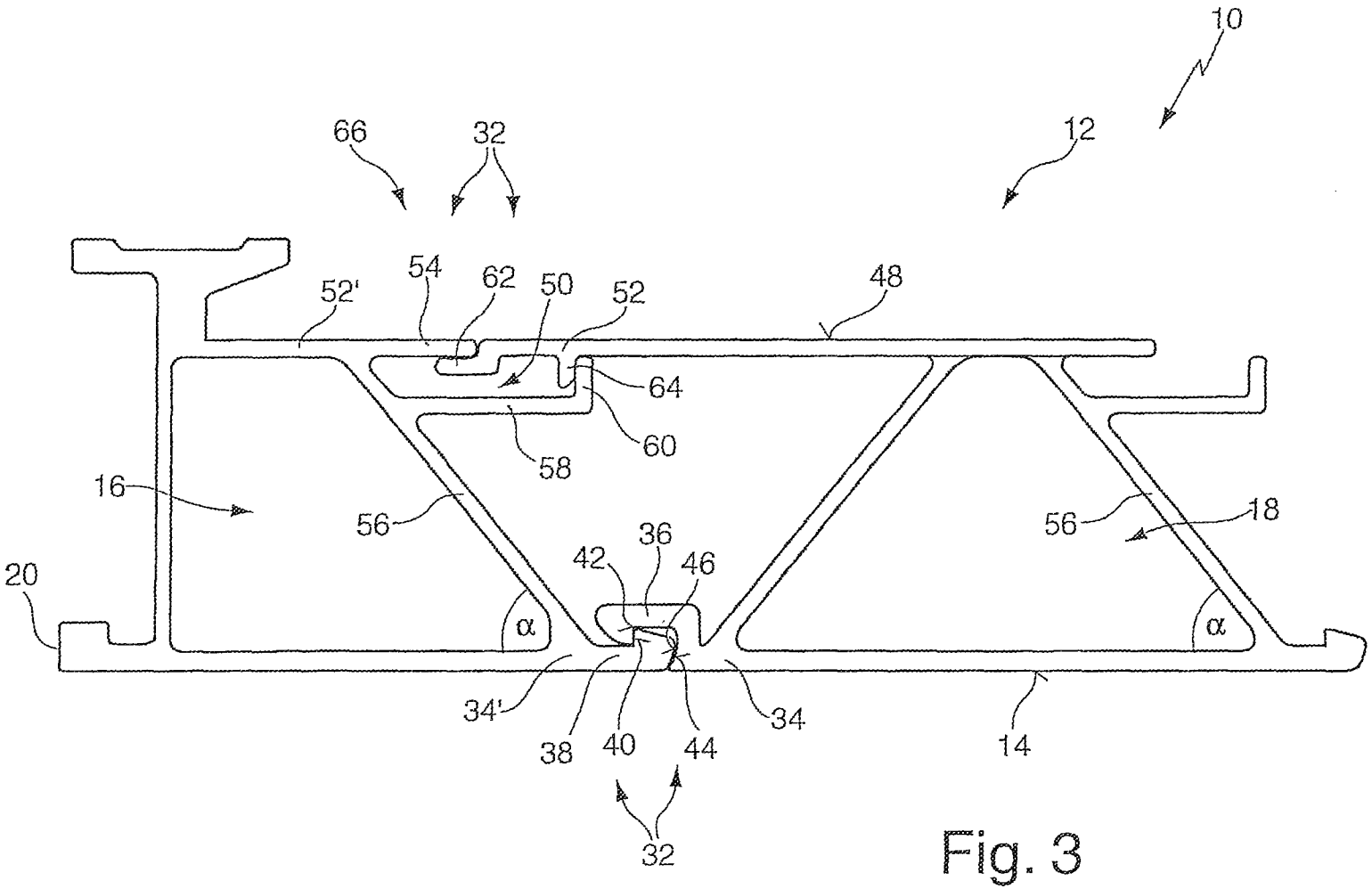
FIG. 3 shows a cross-section through a sub-segment, designed as edge segment, and a joined sub-segment, designed as intermediate profile, of a formwork element similar to FIG. 1.

FIG. 3 shows on the left-hand side an edge segment 16 and an intermediate segment 18 of a base body 12 which engage with one another and are hooked to one another in their engaging edge areas 32. The intermediate segment 18 may be followed by an edge segment 16 or a further intermediate segment 18, which are not illustrated in detail in the figure.

A snap-on hook 36, designed as profiled extension, is formed on an outer wall section 34 of the intermediate segment 18 in the area of the outer side 14 (form lining) of the base body 12, and is locked to a locking element 38 formed on an opposite outer wall section 34' of the edge segment 16. The snap-on hook 36 extends behind and/or over the locking element 38, wherein a retaining surface 40 of the snap-on hook 36 abuts a locking surface 42 of the locking element 38 in a form-locking fashion.

At its front side, the locking element 38 has a ramp-shaped supporting surface 44 which supports a contact surface of the outer wall section 34 of the intermediate segment 18 in a form-locking fashion, the contact surface being designated by 46 and being arranged parallel to the supporting surface 44. The contact surface 46 engages behind the supporting surface 44 of the outer wall section 34'.

The edge segment 16 additionally has a locking groove 50 in the area of an inner side 48 of the base body 12, in which a profiled inner wall section 52 of the intermediate segment 18 is arranged.

The locking groove 50 is partially covered by an inner wall leg 54 of the edge segment 16 projecting parallel with respect to the inner side 48 of the base body 12, and has a groove bottom 58 arranged at one end on a side wall 56 of the edge segment 16, and a groove flank 60 extending at an angle towards the inner side 48 of the base body 12.

The profiled inner wall section 52 of the intermediate segment 18 has an offset edge area 62 which engages below the inner wall leg 54 of the edge segment 16. The profiled inner wall section 52 moreover has a formed-on profiled strip 64 that laterally projects into the locking groove 50 in the direction of its groove bottom 58, the profiled strip abutting the groove flank 60 across its full surface in the locking position of the inner wall section 52 shown in this figure. In accordance with an alternative embodiment that is not illustrated in more detail in the drawing, the groove flank 60 may also be designed as an undercut and be correspondingly engaged behind by the profiled strip 64.

The hooked connection 66 designed as described above extends along the outer and inner sides 14, 48 of the base body 12 and is designed for transmission of force components between the hooked edge segments or intermediate segments 16, 18 of the formwork element 10, which act parallel and perpendicularly with respect to the outer side 14 (form lining) of the base body 12 and load the formwork element 10. Even the high pressure or tensile forces that are exerted in practice by the (fresh) concrete cannot release the hooked connection 66, which holds the edge or intermediate segments 16, 18 together in a dimensionally stable fashion.

Relative displacement of the edge or intermediate segments 16, 18 with respect to one another is only possible by a large (mechanical) force due to friction grip between the edge segments or intermediate segments 16, 18 generated by the hooked connection 66.

The side wall 56 subtends an angle (designated by $\alpha$ in the figure) of approximately 50° with the outer side 14 of the base body 12. The angle $\alpha$ may also have different values, in particular, between 30° and 70° in accordance with embodiments which are not shown in detail above.

Figure 4A:
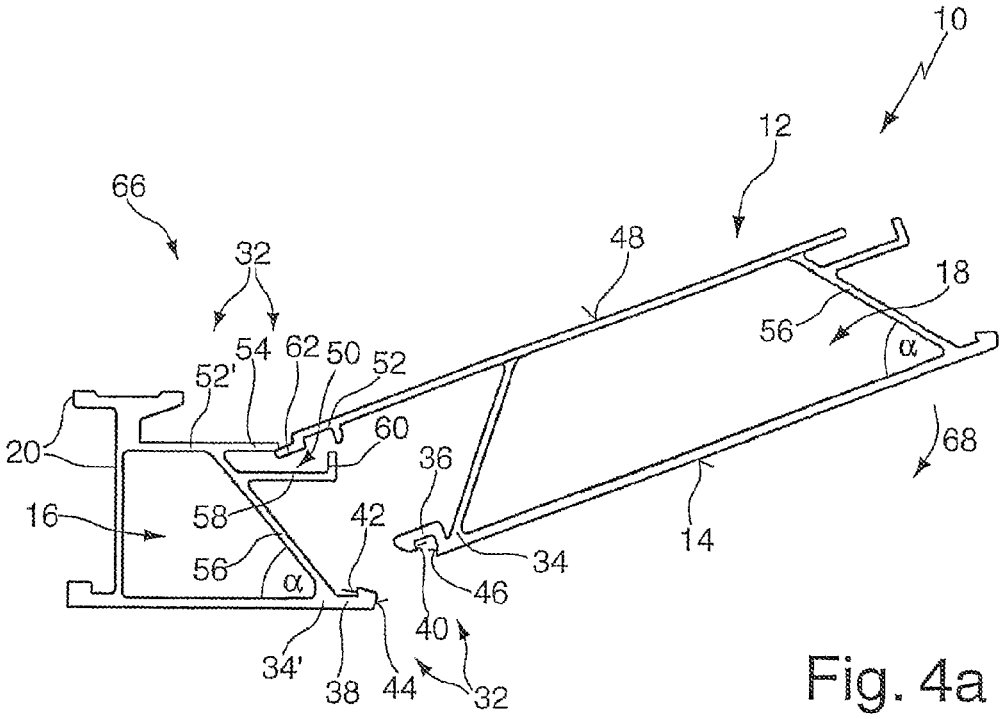
FIGS. 4*a-b* show cross-sections through the sub-segments shown in FIG. 3 during assembly thereof.
Figure 4B:
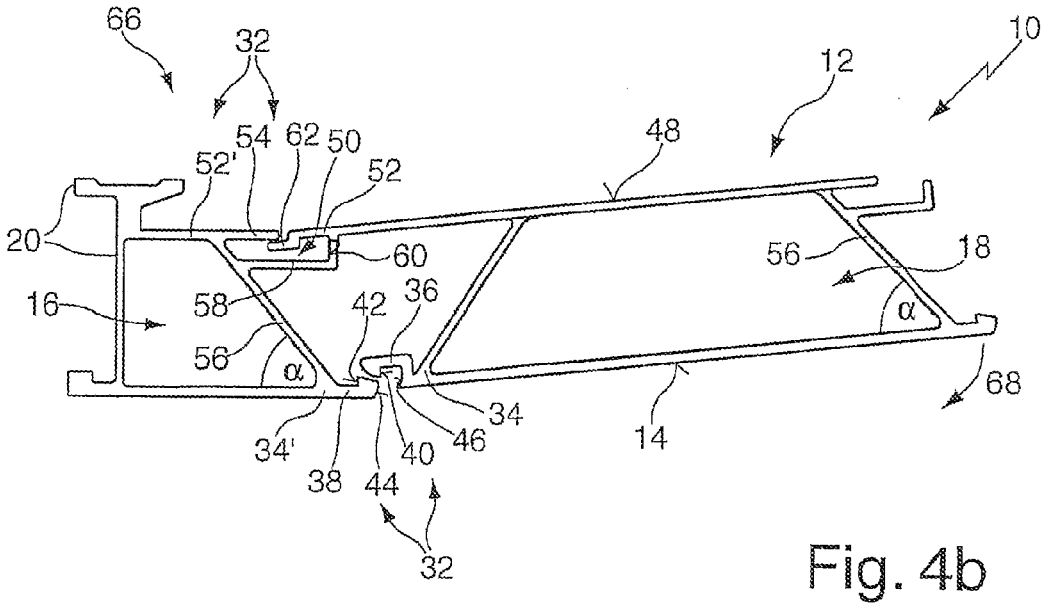

FIGS. 4*a* and 4*b* show the edge segment and intermediate segment 16, 18 during joining or assembly thereof, which is are already connected in FIG. 3.

The intermediate segment 18 illustrated on the right-hand side in the figure is initially introduced or inserted with the offset edge area 62 of its inner wall section 52 into the locking groove 50 of the edge segment 16 illustrated on the left-hand side in the figure, which is shown in more detail in FIG. 4*a*, until the offset edge area 62 is guided below the inner wall leg 54 of the edge segment 16.

The intermediate segment 18 is subsequently pivoted relative to the edge segment 16 in the direction of the arrow designated by 68, thereby forcibly guiding the offset edge area 62 of the inner wall section 52 in the locking groove 50 in a hinge-like fashion, until the snap-on hook 36 is locked with the locking element 38. At the same time, the offset edge area 62 of the inner wall section 52 of the intermediate element 18 is transferred in the locking groove 50 into its locking position characterized by abutment of the profiled rail 64 on the groove flank 60 of the locking groove 50. The hooked connection 66 is thereby established and the edge segment and the intermediate segment 16, 18 are permanently connected to one another as illustrated in FIG. 2.

FIGS. 5*a* to 5*e* show inventive formwork elements 10 of different widths, which result from the plurality of possible combinations of the edge segments or intermediate segments 16, 18.

Figure 5A:
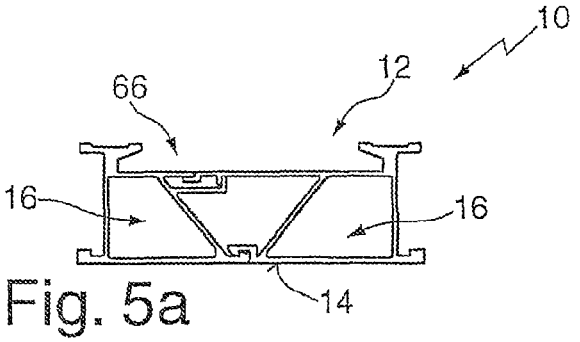
FIGS. 5*a-e* show cross-sections through formwork elements similar to FIG. 1, each having a different width.
Figure 5B:
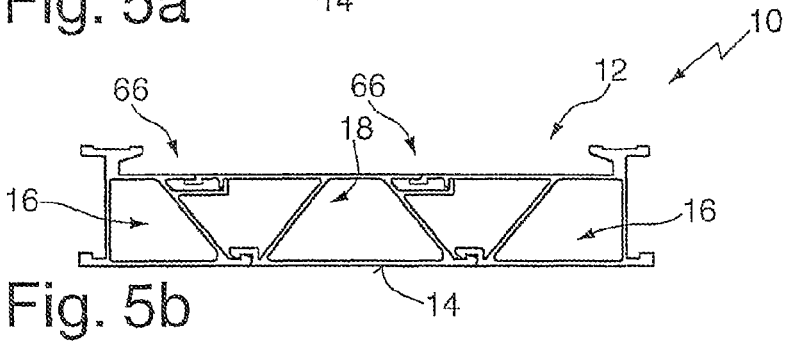
Figure 5C:
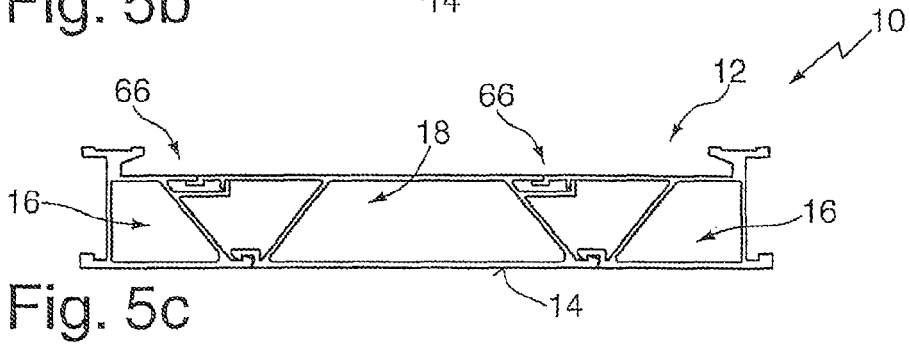
Figure 5D:
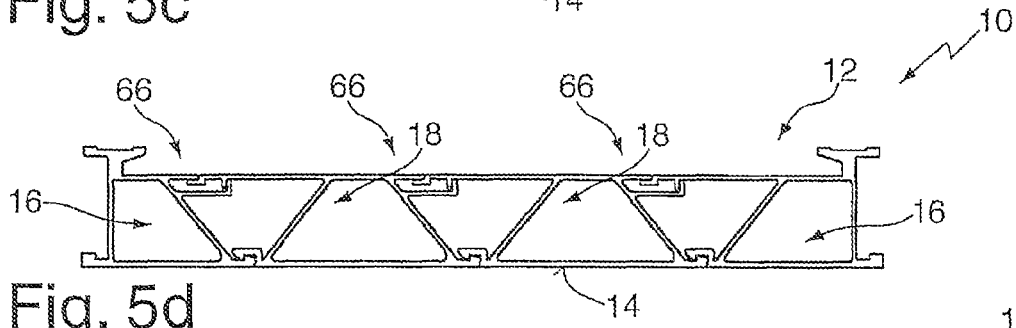
Figure 5E:
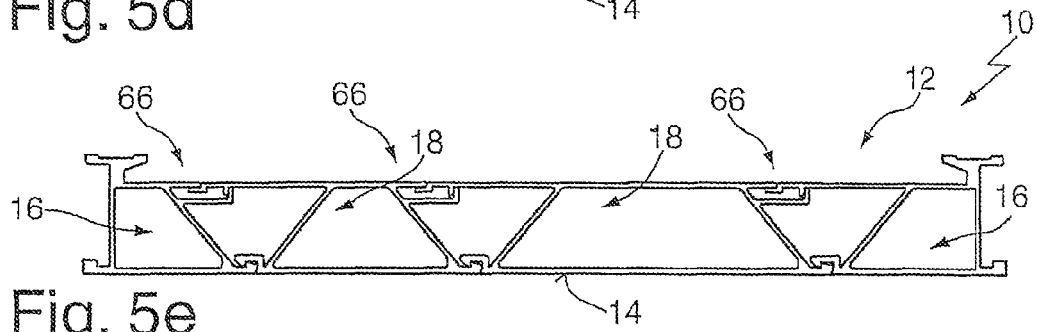

FIG. 5*a* shows a simplest possible structure of the formwork element 10 or of a base body 12 with only two interconnected edge segments 16. In contrast thereto, the formwork element 10 illustrated in FIG. 5*b* additionally has an intermediate segment 18 arranged between the edge segments 16, which, as illustrated in FIG. 5*c*, may also have a larger width. In accordance with the formwork elements 10 shown by way of example in FIGS. 5*d* to 5*e*, the present four differently configured edge segments or intermediate segments 16, 18 only already produce a plurality of possible combinations and therefore formwork elements of different widths. The hooked connections 66 between all edge segments or intermediate segments of the respective formwork elements 10 are thereby basically correspondingly designed. The free ends of the edge segments 16 are therefore either provided with hook elements that positively engage into matching moldings of the intermediate segments 18 or are designed in such a fashion that two edge segments 16 can be permanently connected to one another in accordance with the invention.

The invention concerns a method for manufacturing a formwork element 10 for concrete structures comprising a base body 12 of hollow profile construction having an outer side 14 designed as a form lining. In accordance with the invention, the base body 12 is formed by at least two interlocking sub-segments which are permanently connected to each other at their interlocking edge areas. The sub-segments, such as an edge segment and an intermediate segment 16, 18, which are advantageously produced by extrusion, are hooked to one another and form an inseparable unit in the connected state.

We claim:

1. A method for manufacturing a formwork element for concrete structures, the formwork element comprising:

a base body of hollow profile construction with an outer side constituting a form lining, wherein the base body has at least two interlocking sub-segments which are permanently connected to each other at mutually interlocking edge areas by means of a hooked connection formed proximate inner and outer sides of the sub-segments, thereby constituting an inseparable unit, wherein the hooked connection extends through a large fraction of the entire length of the base body or through a large fraction of an entire length of the inner and outer sides of the base body, with the hooked connection having a locking groove disposed on one sub-segment proximate the inner side of the base body, the locking groove capturing an inner wall section of the other sub-segment, wherein the locking groove is partially covered by an inner wall leg of the sub-segment having that locking groove, the inner wall leg protruding parallel to the inner side of the base body, wherein the locking groove has a groove bottom, one end of which is disposed on a side wall of the sub-segment, and a groove flank angled toward the inner side of the base body, a profiled inner wall section of the other sub segment having an offset edge area which engages below the inner wall leg as well as an integral profiled strip which protrudes into and at a side of the locking groove towards the groove bottom to seat over a large area on the groove flank in a locked position of the inner wall section, wherein the hooked connection has a snap-on hook proximate the outer side of the base body and disposed on one sub-segment, which snaps into locked engagement with a locking element disposed on the other sub-segment, the sub-segments each being hollow-profile structures, the method comprising the steps of:

a) introducing the sub-segment having the offset edge area into the locking groove of the other sub-segment until the offset edge area is guided beneath the inner wall leg of the other sub-segment; and b) establishing, following step a), the hooked connection by pivoting one sub-segment relative to the other sub-segment under forced guidance of the offset edge area of the inner wall section and in a hinge-like manner in the locking groove until the snap-on hook snaps into locked engagement with the locking element, thereby bringing the offset edge area of the inner wall section of the one sub-segment into a locked position in which the profiled strip of the one sub-segment seats on the groove flank of the locking groove of the other sub-segment.

2. The method of claim 1, wherein the sub-segments are designed as edge segments and/or intermediate segments.

3. The method of claim 2, wherein the edge segments and/or intermediate segments have differing widths.

4. The method of claim 1, wherein the sub-segments have at least one side wall which subtends an angle with the outer side of less than 90°.

* * * * *